US006200939B1

(12) United States Patent
Maurer

(10) Patent No.: US 6,200,939 B1
(45) Date of Patent: Mar. 13, 2001

(54) BIOCOMPOSITIBLE CLEANING AND DEODORIZING COMPOSITIONS FOR MEDICAL DEVICES

(75) Inventor: Gerald L. Maurer, Cincinnati, OH (US)

(73) Assignee: National Research Labs, Cincinnati, OH (US)

( * ) Notice: Subject to any disclaimer, the term of this patent is extended or adjusted under 35 U.S.C. 154(b) by 0 days.

(21) Appl. No.: 09/335,942

(22) Filed: Jun. 18, 1999

(51) Int. Cl.[7] ..... C11D 9/50; C11D 3/48

(52) U.S. Cl. ..... 510/161; 510/245; 510/254; 510/363; 510/398; 510/421; 510/434; 510/477; 510/533; 134/42

(58) Field of Search ..... 510/161, 245, 510/254, 363, 398, 421, 434, 477, 533; 134/42

(56) References Cited

U.S. PATENT DOCUMENTS

| | | | |
|---|---|---|---|
| 4,055,655 | 10/1977 | Maurer et al. | 424/294 |
| 4,385,632 | 5/1983 | Odelhög | 604/360 |
| 4,666,616 | 5/1987 | Rossmoore | 252/11 |
| 4,680,309 | 7/1987 | Maurer | 514/499 |
| 4,707,282 | 11/1987 | Rossmoore | 252/11 |
| 4,708,808 | 11/1987 | Rossmoore | 252/11 |
| 4,708,864 | 11/1987 | Maurer | 424/49 |
| 5,047,022 | 9/1991 | Hasebe et al. | 604/359 |
| 5,076,960 | 12/1991 | Hutchings et al. | 252/186.33 |
| 5,403,505 * | 4/1995 | Hachmann et al. | 252/106 |
| 5,534,249 | 7/1996 | Maurer | 424/76.3 |
| 5,643,971 | 7/1997 | Roenigk | 523/122 |
| 5,813,058 | 9/1998 | Quigley et al. | 4/309 |

* cited by examiner

*Primary Examiner*—Mark Kopec
*Assistant Examiner*—Brian P. Mruk
(74) *Attorney, Agent, or Firm*—Dinsmore & Shohl LLP

(57) ABSTRACT

Biocompatible aqueous biocompatible cleaning and deodorizing compositions comprise (i) a biocompatible high osmotic pressure material, (ii) a Polycarboxylic acid salt, (iii) a polyhydric alcohol, (iv) a nonionic surfactant, and (v) an odor elimination agent, in water. The compositions are particularly suitable for cleaning and deodorizing medical devices which are designed for receiving and/or holding human waste. Preferably, the compositions are free of non-biocompatible or toxic components and have a relatively neutral pH, whereby the compositions are not harmful to human skin upon contact.

19 Claims, No Drawings

BIOCOMPOSITIBLE CLEANING AND DEODORIZING COMPOSITIONS FOR MEDICAL DEVICES

FIELD OF THE INVENTION

The present invention is directed to biocompatible cleaning and deodorizing compositions for medical devices, and more particularly to compositions for cleaning and deodorizing medical devices which are designed for receiving and/or holding human waste. Preferably, the compositions are free of non-biocompatible or toxic components and have a relatively neutral pH, whereby the compositions are not harmful to human skin upon contact.

BACKGROUND OF THE INVENTION

Medical devices known generally as ostomy appliances, and more specifically as colostomy, ileostomy and urostomy appliances or bags, are designed to receive and contain human metabolic wastes when the natural routes of elimination of these bodily wastes have been circumvented, either temporarily or permanently by surgical intervention such as ileostomy, colostomy, urostomy or the like and/or during processes such as catheterization, wound drainage, or the like. Similarly, medical devices generally known as incontinence appliances, and more specifically as urinary and fecal collection appliances or bags, are designed to receive and contain human metabolic wastes, such as urine and feces.

Ostomy and incontinence appliances are carefully engineered to provide patient comfort, safety, ease of use and security against leakage of the contents into the environment, and typically include valves to prevent siphoning effects and provide for easy emptying of the appliances. The majority of appliances in use today are made of strong, pliable, non-toxic, hypoallergenic plastic polymers or natural or synthetic rubbers. These devices are needed on a continual basis by many patients and typically represent a significant expense to the user. As is apparent, the per use cost of an ostomy or incontinence appliance decreases as the number of uses increases. Accordingly, as an ostomy or incontinence appliance becomes full during use, it is typically emptied by either the user or a care giver and then re-attached to the evacuation site for re-use, thereby reducing replacement costs.

Unfortunately, the useful life of an ostomy or incontinence appliance is often limited as substances present in human waste can soil and stain the appliance, obstruct valves and flow paths, and/or cause intense odors which absorb to the surfaces of tide appliance and escape into the environment. The bad odors which are typically associated with the use of ostomy and incontinence appliances often represent a serious threat to the psychological well being of the users and cause them to isolate from society. It is therefore desirable to clean ostomy and incontinence appliances before re-use. This not only requires extra effort for the user or care giver, but prior art ostomy and incontinence appliance cleaning compositions have generally been found to be essentially ineffective and even potentially dangerous to use.

For example, the conventional cleaning compositions are typically cumbersome to use as they contain strong acids which can burn the skin and eyes upon contact during use. Additionally, if even traces of the strong acids remain on the exterior surfaces of the appliance, they can cause skin irritation to the user. Moreover, the conventional compositions are typically only marginally effective in actually cleaning the appliance, and none of the commercially available compositions which the present inventor is aware of are effective against the primary causes of appliance failure, namely malodor, staining, and clogging of the valves and other flow mechanisms. As a result, many users replace the appliance daily, without reuse, and thereby incur significant costs, or attempt to clean the appliances with generally ineffective home remedies such as vinegar and water.

Accordingly, a need exists for improved cleaning and deodorizing compositions for use in cleaning medical devices, particularly ostomy and incontinence appliances and the like, which are both effective and easily and safely employed to allow reuse of the devices.

SUMMARY OF THE INVENTION

Accordingly, it is an object of the present invention to provide improved cleaning and deodorizing compositions. It is an additional object of the present invention to provide biocompatible cleaning and deodorizing compositions which overcome disadvantages of the prior art. It is a more specific object of the invention to provide biocompatible cleaning and deodorizing compositions which are suitable for use in cleaning and deodorizing medical devices, for example ostomy and incontinence appliances, and thereby allow reuse of the devices. It is a further object of the invention to provide such compositions which are safe for use in environments where contact of the compositions with humans is anticipated or not easily prevented.

These and additional objects are provided by the biocompatible cleaning and deodorizing compositions of the present invention. More particularly, the invention is directed to biocompatible aqueous cleaning and deodorizing compositions comprising (i) a biocompatible high osmotic pressure material, (ii) a polycarboxylic acid salt, (iii) a polyhydric alcohol, (iv) a nonionic surfactant, and (v) an odor elimination agent., in water. Preferably, the aqueous biocompatible cleaning and deodorizing compositions comprise, by weight, (i) from about 2% to about 20% of the biocompatible high osmotic pressure material, (ii) from about 2% to about 20% of the polycarboxylic acid salt, (iii) from about 2% to about 20% of the polyhydric alcohol, (iv) from about 0.1% to about 10% of the nonionic surfactant, and (v) from about 0.1% to about 10% of the odor elimination agent, in water. That the compositions are biocompatible means that, upon contact with normal human or animal tissue, the compositions do not cause a detectable alteration of the normal structure or function of the tissue.

The invention is further directed to articles of manufacture in the form of kits for cleaning and deodorizing a device. The kits comprise (a) a first container provided with a concentrated aqueous biocompatible cleaning and deodorizing composition comprising (i) a biocompatible high osmotic pressure material, (ii) a polycarboxylic acid salt, (iii) a polyhydric alcohol, (iv) a nonionic surfactant, and (v) an odor elimination agent, in water, and (b) a second container for receiving a portion of the concentrated aqueous composition and a diluting amount of water. The second container is provided with means for measuring the portion of concentrated aqueous composition to be received therein and a dispenser for dispensing a diluted aqueous cleaning and deodorizing composition therefrom.

In an additional embodiment, the invention is directed to methods for cleaning and deodorizing a medical device, for example an ostomy or incontinence appliance. The methods comprise applying to the device an aqueous biocompatible cleaning and deodorizing composition comprising (i) a biocompatible high osmotic pressure material, (ii) a polycarboxylic acid salt, (iii) a polyhydric alcohol, (iv) a nonionic surfactant, and (v) an odor elimination agent, in water.

The compositions, articles of manufacture and methods according to the present invention are advantageous in that they are effective in cleaning and deodorizing medical devices, including, but not limited to, devices adapted for receiving or holding human waste such as ostomy and incontinence appliances, and are free of non-biocompatible or toxic components and have a relatively neutral pH, whereby the compositions are not harmful to human skin upon contact.

These and additional objects and advantages provided by the compositions, articles of manufacture and methods of the present invention will be more fully apparent in view of the following detailed description.

DETAILED DESCRIPTION

The present invention is directed to biocompatible cleaning and deodorizing compositions for medical devices, and more particularly to compositions for cleaning and deodorizing medical devices which are designed for receiving and/or holding human waste. It is believed that the present compositions, unlike various conventional compositions, effectively address the chemistry that typically causes the failure of devices such as ostomy and incontinence appliances, and therefore provide improved cleaning and deodorizing effects.

More particularly, many prior art compositions are based on the use of strong acids such as phosphoric or glycolic acids, presumably to "dissolve" debris which clogs the appliance. While such acids have the ability to dissolve certain types of salts, for example, alkaline earth metal phosphates, urates and oxalates, it has been discovered, surprisingly, that these salts contribute minimally to the failure of ostomy and incontinence appliances. These acids are of little use against what has now been discovered as the actual causes of ostomy and incontinence appliance failure, and, as mentioned, these acids, which are typically used at a pH of less than 1.0, can be irritating and otherwise hazardous to the user.

During normal use of, for example, a urostomy or urinary incontinence appliance, urine flows through plastic tubing to the interior of the appliance. The urine contains many dissolved chemicals, colloidal particles and solid elements such as crystals, for example, phosphates, urates and oxalates, blood and epithelial cells. However, typically only very minimal amounts of solid materials in the form or precipitated crystalline substances such as calcium or magnesium salts of phosphorous or phosphoric acid, oxalic acid, uric acid or cysteine are present. Rather, it has now been discovered that a major cause of appliance clogging and the problems attendant such clogging are the result of coagula consisting of a complex mixture of cells, for example, red blood cells, white blood cells, sloughed epithelial cells and bacterial cells, very tiny crystals and mucous.

Surprisingly, mucus alone can cause clogging of the flow channels of an ostomy or incontinence appliance, as mucus coats surfaces very effectively, including the interior surfaces of tubing, vent valves, drain valves and the ostomy or incontinence bag itself. Mucus is a slimy material that coats many epithelial surfaces and is composed of mucins and inorganic salts suspended in water. It protects the epithelial surfaces against contact with harmful substances and, generally, is formed in large quantities when the epithelial surfaces are irritated by, for example, the insertion of a foreign body such as a catheter. Mucins are heavily glycosylated proteins containing, among others, the sulfur-containing amino acid cysteine, as well as many glycosyl residues. Mucins are composed of monomer repeating units; both hydrogen bonding and disulfide linkages lead to the formation of the secreted "mucus" which contains massive mucin moieties of up to 10 million Daltons in molecular weight. The mucin aggregates are extremely hydrophilic as well as thixotropic, adsorbing large amounts of water. They are very resistant to chemical degradation by acids such as conventionally employed phosphoric and glycolic acids, by alkalis, and by proteolytic enzymes. It is, therefore, essentially impossible to "destroy" mucus by any but the very strongest acids or bases, both of which are extremely dangerous to handle.

The biocompatible cleaning and deodorizing compositions according to the present invention comprise a combination of components which, surprisingly, provide an effective means for cleaning and deodorizing medical devices such as ostomy and incontinence appliances, and particularly for cleaning the appliances of mucus, cells and other debris which cause staining, clogging and/or malodors. The biocompatible aqueouis cleaning and deodorizing compositions comprise (i) a biocompatible high osmotic pressure material, (ii) a polycarboxylic acid salt, (iii) a polyhydric alcohol, (iv) a nonionic surfactant, and (v) an odor elimination agent, in water.

While not intending to be limited by theory, it is believed that the combination of components, and particularly the use of the biocompatible high osmotic pressure material, mediated with the polycarboxylic acid salt and the nonionic surfactant, takes advantage of the physico-chemical structure of the mucin polymers and employs substances that disrupt the bonds that bind the mucin monomers together to form the high molecular weight, "sticky" mucous strands. When contacted with a device such as a used ostomy or incontinence appliance in an effective amount, the compositions of this invention disrupt the integrity of the mucous polymer, dispersing the coagula of mucus, crystals and cellular components into minute, free flowing fragments that are easily rinsed from the affected surfaces. This is advantageously accomplished at or near the physiological pH range of from about 7 to about 8.

The biocompatible high osmotic pressure material may comprise any such material which is effective to disrupt the integrity of the mucous polymers and disperse the mucous aggregates. Preferably, the biocompatible high osmotic pressure material comprises an acetate salt, and more preferably comprises an alkali metal acetate salt, with sodium acetate being particularly preferred.

The polycarboxylic acid salt which is included in the compositions of the invention may comprise a salt of a dicarboxylic acid, a tricarboxylic acid or higher polycarboxylic acid compound or polymer, or a mixture thereof. In a preferred embodiment, the polycarboxylic acid salt comprises an alkali metal citrate, with trisodium citrate being particularly preferred. The polycarboxylic acid salt can dissolve many of the crystalline materials that are found in urine and that contribute to ostomy and incontinence appliance failure.

The nonionic surfactant which is included in the compositions of the invention may comprise any nonionic surfactant which is effective to mediate the high osmotic pressure material. Preferably, the nonionic surfactant comprises an alkoxylaited material, and particularly an ethoxylated nonionic surfactant. In more preferred embodiments, the nonionic surfactant comprises an ethoxylated alkyl phenol, containing, for example, from about 2 to about 20 ethoxy groups per molecule.

The compositions further include a polyhydric alcohol, suitably in an amount effective to assist in dissolving crystal materials, for example uric acid crystals. In a preferred embodiment, the polyhydric alcohol comprises glycerine, although other polyhydric alcohols are well known in the art and may be used in place of glycerine. Examples of additional polyhydric alcohols include, but are not limited to diols, triols and polyols such as polyethylene glycol.

Additionally, the compositions of the invention incorporate an odor elimination agent. As noted above, mucus includes cysteine, a sulfur-containing amino acid. Bacterial action on mucus liberates sulfides and mercaptans which contribute to the foul odor present in waste that is stored in ostomy or incontinence appliances. The odor elimination agent may be any suitable agent which reacts with odorogenic molecules to reduce malodors, rather than merely masking odor causing materials. In a preferred embodiment, the odor elimination agent comprises a complex of one or more metals and a polyfunctional ligand. In a further preferred embodiment, the odor elimination agent comprises a complex of one or more metals and a polyfunctional organic ligand. Suitable metal complexes include, but are not limited to, those disclosed in the Maurer et al U.S. Pat. Nos. 4,055,655 and 4,278,610, both of which are incorporated herein by reference. Typically, the metal ion which forms the complex may comprise a monovalent or polyvalent ion. Divalent metals such as copper and zinc are preferred. The polyfunctional ligand may be organic or inorganic in nature, with such ligands being known in the art. Preferred polyfunctional organic ligands comprise an alpha or beta hydroxy carboxylic acid, for example citric acid, or, alternatively, another functionally substituted acid such as an alpha or beta amino, sulfhydro, phosphinol or the like substituted carboxylic. A preferred polyfunctional organic ligand comprises citric acid. In an additionally preferred embodiment, the complex comprises a 1:1 monometal:polyfunctional organic ligand chelate, or a salt thereof. Monoalkali and polyalkali salts are preferred. Examples of specific complexes for use in the present invention include disodium monocopper citrate and disodium monozinc citrate. Extensive toxicological testing of these complexes indicates they are biocompatible and safe for the embodiments disclosed herein.

The compositions are in an aqueous form and generally comprise a balance of water, although other conventional components may be included, if desired, as long as the biocompatible nature of the compositions is not lost. The cleaning and deodorizing compositions of the invention preferably have a neutral pH value of about 7.0–8.0. Preferably, the pH of the compositions is in the range of from about 7.3 to about 7.4. A physiologically compatible buffering agent may be employed in the present compositions to adjust the pH as necessary. Physiologically compatible buffers are generally known in the art. The compositions may further optionally include a perfume component to provide a pleasant scent. It is important to recognize, however, that the perfume component is not employed to mask malodors as the odor elimination agent reacts with odorogenic molecules to neutralize the malodors.

In preferred embodiments, the aqueous biocompatible cleaning and deodorizing compositions comprise, by weight, (i) from about 2% to about 20% of the biocompatible high osmotic pressure material, (ii) from about 2% to about 20% of the polycarboxylic acid salt, (iii) from about 2% to about 20% of the polyhydric alcohol, (iv) from about 0.1% to about 10% of the nonionic surfactant, and (v) from about 0.1% to about 10% of the odor elimination agent, in water. In further preferred embodiments, the aqueous biocompatible cleaning and deodorizing compositions comprise, by weight, (i) from about 5% to about 10% of the biocompatible high osmotic pressure material, (ii) from about 5% to about 10% of the polycarboxylic acid salt, (iii) from about 5% to about 10% of the polyhydric alcohol, (iv) from about 1% to about 5% of the nonionic surfactant, and (v) from about 1% to about 5% of the odor elimination agent, in water, These compositions are relatively concentrated and are suitable for dilution with additional water before use for cleaning and deodorizing. For example, the aforementioned preferred compositions are suitable for dilution with water in amount of from about 5:1 to about 100:1 of water:concentrated cleaning and deodorizing composition for use in cleaning medical devices such as ostomy and incontinence appliances.

In a further embodiment, the invention is directed to articles of manufacture in the form of kits for cleaning and deodorizing a device. The kits comprise (a) a primary container provided with the concentrated aqueous biocompatible cleaning and deodorizing composition as discussed above and comprising (i) a biocompatible high osmotic pressure material, (ii) a polycarboxylic acid salt, (iii) a polyhydric alcohol (ill) a nonionic.surfactant, and (v) an odor elimination agent, in water, and (b) a secondary container for receiving a portion of the concentrated aqueous composition and a diluting amount of water. The secondary container is provided with means for measuring the portion of concentrated aqueous composition to be received therein and a dispenser for dispensing a diluted aqueous cleaning and deodorizing composition therefrom. The measuring means may comprise, but is not limited to, indicia on the secondary container, for example a fill line to which the concentrated composition is to be added, an appropriately sized cap for measuring a recommended portion of the concentrated composition, or the like. The dispenser which is included may take any form known in the art and is effective for delivering a diluted aqueous cleaning and deodorizing composition from the secondary container to a device to be cleaned, and preferable to an ostomy or incontinence appliance and the tubing and valving associated therewith A squeeze bottle provided with a nozzle and a nozzle cap which is sized appropriately to measure a portion of concentrated cleaning and deodorizing composition for dilution in the bottle is one embodiment of the secondary container for use in the kits of the present invention.

The compositions, articles of manufacture and methods according to the present invention are illustrated by the following example which is intended to be nonlimiting of the invention disclosed herein. In the example and throughout the specification, parts, percentages and ratios are by weight unless otherwise specified.

EXAMPLE

A composition according to the present invention is prepared by combining the following components:

| Component | Weight Percent |
|---|---|
| Acetate Salt (Sodium Acetate) | 5.00% |
| Polycarboxylic Acid Salt (Trisodium Citrate) | 5.00% |
| Polyhydric Alcohol (Glycerine) | 7.50% |
| Non-ionic Surfactant (Ethoxylated octyl phenol) | 2.00% |
| Odor Elimination Agent (Disodium Monocopper Citrate (MCC)) | 2.50% |
| Fragrances (Apple Extract) | 1.50% |
| Water | q.s. 100% |

To clean and deodorize a used ostomy or incontinence appliance, an effective amount of the above composition is diluted with water, typically about 1 part of the composition to about 50 parts of water. The diluted composition is introduced into the appliance, agitated and drained. The appliance is now ready to be reused. Due to the non-toxic, non-irritating nature of this composition, no rinsing or special care has to be taken, unlike many conventional compositions which, as mentioned above, contain strong, potentially irritating acids.

Surprisingly, the compositions of this invention are equally effective in cleaning and deodorizing the aforementioned appliances for re-use. The compositions are very effective in dispersing human metabolic wastes, cleaning the interior flow paths of the appliances and deodorizing them for satisfactory re-use.

The present example and the specific embodiments set forth in the present specification are provided to illustrate various embodiments of the invention and are not intended to be limiting thereof. Additional embodiments within the scope of the present claims will be apparent to one of ordinary skill in the art.

What is claimed is:

1. An aqueous biocompatible cleaning and deodorizing composition, comprising (i) a biocompatible high osmotic pressure material, (ii) a polycarboxylic acid salt, (iii) a polyhydric alcohol, (iv) a nonionic surfactant, and (v) an odor elimination agent comprising a complex of at least one metal and a polyfunctional ligand, in water.

2. An aqueous biocompatible cleaning and deodorizing composition as defined by claim 1, comprising, by weight, (i) from about 2% to about 20% of the biocompatible high osmotic pressure material, (ii) from about 2% to about 20% of the polycarboxylic acid salt, (iii) from about 2% to about 20% of the polyhydric alcohol, (iv) from about 0.1% to about 10% of the nonionic surfactant, and (v) from about 0.1% to about 10% of the odor elimination agent, in water.

3. An aqueous biocompatible cleaning and deodorizing composition as defined by claim 1, comprising, by weight, (i) from about 5% to about 10% of the biocompatible high osmotic pressure material, (ii) from about 5% to about 10% of the polycarboxylic acid salt, (iii) from about 5% to about 10% of the polyhydric alcohol, (iv) from about 1% to about 5% of the nonionic surfactant, and (v) from about 1% to about 5% of the odor elimination agent, in water.

4. An aqueous biocompatible cleaning and deodorizing composition as defined by claim 1, wherein the biocompatible high osmotic pressure material comprises an acetate salt.

5. An aqueous biocompatible cleaning and deodorizing composition as defined by claim 4, wherein the biocompatible high osmotic pressure material comprises an alkali metal acetate salt.

6. An aqueous biocompatible cleaning and deodorizing composition as defined by claim 1, wherein the polycarboxylic acid salt comprises an alkali metal citrate.

7. An aqueous biocompatible cleaning and deodorizing composition as defined by claim 1, wherein the polyhydric alcohol comprises glycerine.

8. An aqueous biocompatible cleaning and deodorizing composition as defined by claim 1, wherein the nonionic surfactant comprises an ethoxylated alkyl phenol.

9. An aqueous biocompatible cleaning and deodorizing composition as defined by claim 1, wherein the odor elimination agent comprises a complex of at least one metal and a polyfunctional organic ligand.

10. An aqueous biocompatible cleaning and deodorizing composition as defined by claim 9, wherein the odor elimination agent comprises a monometal citrate.

11. An aqueous biocompatible cleaning and deodorizing composition as defined by claim 9, wherein the odor elimination agent comprises monocopper citrate or monozinc citrate.

12. An aqueous biocompatible cleaning and deodorizing composition as defined by claim 1, wherein the composition has a pH of from about 7 to about 8.

13. An aqueous biocompatible cleaning and deodorizing composition as defined by claim 1, wherein the composition has a pH of from about 7 to about 7.5.

14. An aqueous biocompatible cleaning and deodorizing composition as defined by claim 1, wherein the composition further comprises a fragrance component.

15. An aqueous biocompatible cleaning and deodorizing composition, comprising, by weight, (i) from about 5% to about 10% of a biocompatible high osmotic pressure material comprising an alkali metal acetate, (ii) from about 5% to about 10% of an alkali metal citrate, (iii) from about 5% to about 10% of glycerine, (iv) from about 1% to about 5% of an ethoxylated alkyl phenol, and (v) from about 1% to about 5% of an odor elimination agent comprising monocopper citrate, monozinc citrate, or a mixture thereof, in water.

16. A kit for cleaning and deodorizing a device, the kit comprising (a) a primary container provided with a concentrated aqueous biocompatible cleaning and deodorizing composition comprising (i) a biocompatible high osmotic pressure material, (ii) a polycarboxylic acid salt, (iii) a polyhydric alcohol, (iv) a nonionic surfactant, and (v) an odor elimination agent comprising a complex of at lest one metal and a polyfunctional ligand, in water, and (b) a secondary container for receiving a portion of the concentrated aqueous composition and a diluting amount of water, the secondary container being provided with means for measuring the portion of concentrated aqueous composition to be received therein and a dispenser for dispensing a diluted aqueous cleaning and deodorizing composition therefrom.

17. A kit as defined by claim 16, wherein the concentrated aqueous cleaning and deodorizing composition comprises, by weight, (i) from about 2% to about 20% of the biocompatible high osmotic pressure material, (ii) from about 2% to about 20% of the polycarboxylic acid salt, (iii) from about 2% to about 20% of the polyhydric alcohol, (iv) from about 0.1% to about 10% of the nonionic surfactant, and (v) from about 0.1% to about 10% of the odor elimination agent, in water.

18. A method of cleaning and deodorizing a medical device, comprising applying to the device an aqueous biocompatible cleaning and deodorizing composition comprising (i) a biocompatible high osmotic pressure material, (ii) a polycarboxylic acid salt, (iii) a polyhydric alcohol, (iv) a nonionic surfactant, and (v) an odor elimination agent comprising a complex of at least one metal and a polyfunctional ligand, in water.

19. A method as defined by claim 18, wherein the medical device is an apparatus for receiving or holding human waste.

* * * * *

UNITED STATES PATENT AND TRADEMARK OFFICE

CERTIFICATE OF CORRECTION

PATENT NO. : 6,200,939 B1
DATED : March 13, 2001
INVENTOR(S) : Gerald L. Maurer

It is certified that error appears in the above-identified patent and that said Letters Patent is hereby corrected as shown below:

Column 8, claim 16,
Line 25, change "lest" to -- least --.

Signed and Sealed this

Thirteenth Day of November, 2001

*Attest:*

Nicholas P. Godici

NICHOLAS P. GODICI
*Acting Director of the United States Patent and Trademark Office*

*Attesting Officer*